US008132415B2

(12) United States Patent
Lee et al.

(10) Patent No.: US 8,132,415 B2
(45) Date of Patent: Mar. 13, 2012

(54) FUEL NOZZLE OF GAS TURBINE COMBUSTOR FOR DME AND DESIGN METHOD THEREOF

(75) Inventors: Min Chul Lee, Daejeon (KR); Dal Hong Ahn, Daejeon (KR); Yong Jin Joo, Daejeon (KR); Seok Bin Seo, Daejeon (KR); Jae Hwa Chung, Daejeon (KR); Won Shik Park, Daejeon (KR); Hae Kyung Seo, Daejeon (KR)

(73) Assignee: Korea Electric Power Corporation, Seoul (KR)

( * ) Notice: Subject to any disclaimer, the term of this patent is extended or adjusted under 35 U.S.C. 154(b) by 896 days.

(21) Appl. No.: 12/215,159

(22) Filed: Jun. 25, 2008

(65) Prior Publication Data

US 2009/0084109 A1 Apr. 2, 2009

(30) Foreign Application Priority Data

Sep. 28, 2007 (KR) ..... 10-2007-0097756

(51) Int. Cl.
*F02C 1/00* (2006.01)
*F02G 3/00* (2006.01)

(52) U.S. Cl. ..... 60/740; 60/742; 60/746; 60/747

(58) Field of Classification Search ..... 60/737, 60/740, 742, 746, 747, 776, 804
See application file for complete search history.

(56) References Cited

U.S. PATENT DOCUMENTS

| | | | | |
|---|---|---|---|---|
| 4,566,268 | A * | 1/1986 | Hoffeins et al. | 60/39.463 |
| 5,492,277 | A * | 2/1996 | Tani et al. | 239/585.5 |
| 6,520,145 | B2 * | 2/2003 | Hunkert | 123/305 |
| 6,691,516 | B2 * | 2/2004 | Stuttaford et al. | 60/737 |
| 6,871,488 | B2 * | 3/2005 | Oskooei et al. | 60/39.465 |
| 6,928,823 | B2 * | 8/2005 | Inoue et al. | 60/776 |
| 6,983,600 | B1 * | 1/2006 | Dinu et al. | 60/737 |
| 6,983,605 | B1 * | 1/2006 | Hook et al. | 60/775 |
| 2005/0241319 | A1 * | 11/2005 | Graves et al. | 60/776 |

* cited by examiner

*Primary Examiner* — Ehud Gartenberg
*Assistant Examiner* — Michael B Mantyla
(74) *Attorney, Agent, or Firm* — McDermott Will & Emery LLP

(57) ABSTRACT

Disclosed herein are a fuel nozzle of a gas turbine combustor for dimethyl ether (DME, $CH_3OCH_3$) and a design method thereof. The fuel nozzle includes a pilot fuel injection hole formed at the center of the nozzle and a plurality of fuel injection ports formed at equiangular positions around the pilot fuel injection hole to inject DME. Each of the fuel injection ports includes a pair of upper and lower DME injection orifices communicating with a fuel-air mixture injection swirler. The upper DME injection orifice becomes gradually wider, whereas the lower DME injection orifice becomes gradually narrower. Thus, DME can be optimally combusted in the gas turbine combustor, thereby achieving cost reduction of power plants, enhancement in reliability of the power plants, and diversification of usable fuel.

4 Claims, 2 Drawing Sheets

FUEL NOZZLE OF GAS TURBINE COMBUSTOR FOR DME AND DESIGN METHOD THEREOF

BACKGROUND OF THE INVENTION

1. Field of the Invention

The present invention relates to a fuel nozzle of a gas turbine combustor for dimethyl ether (DME, $CH_3OCH_3$) and a design method thereof. More particularly, the present invention relates to a fuel nozzle of a gas turbine combustor for DME and a design method thereof that can obtain optimal combustion of DME in the gas turbine combustor, thereby achieving cost reduction of power plants, enhancement in reliability of the power plants, and diversification of usable fuel.

2. Description of the Related Art

As is well known in the related art, dimethyl ether (DME) has recently been in the spotlight as a new clean fuel since it can be produced from various raw materials such as natural gas, coal, coal bed methane, etc., permits convenient transportation and storage like Liquefied Petroleum Gas (LPG), and has good exhaust characteristics.

Generally, DME has a lower heating value, a higher combustion rate and a lower ignition temperature than those of natural gas used as the primary fuel for gas turbines. Therefore, if DME is directly applied to existing combustors, the combustor is likely to experience damage due to liquefaction and combustion oscillation.

For example, when DME is applied to a dry low $NO_x$ gas turbine combustor, there are problems of flame back, combustion oscillation, combustion instability, etc. due to the high combustion velocity and the low ignition temperature.

SUMMARY OF THE INVENTION

In a general power plant using a gas turbine, natural gas containing as much as 85% or more methane ($CH_4$) is used as a primary fuel while oil distillates are used as a back up fuel. However, market prices of such fuel are volatile. To cope with the volatile market price of the fuel, there is a need to develop a gas turbine capable of employing diverse fuels for the power plants. Particularly, a new fuel, e.g., dimethyl ether (DME) produced from various raw materials such as natural gas, coal, biomass, etc. by a chemical process will be used in the future in consideration of economical and technical efficiency.

However, since DME has a high combustion velocity and a low ignition temperature, a combustor is likely to experience damage caused by flame back when it is used in the gas turbine. Further, since DME has a low heating value, 28.8 MJ/kg (59.3 MJ/$Nm^3$), which is lower than the heating value of natural gas, 49.0 MJ/kg (35.9 MJ/$Nm^3$), modification of the combustor is required.

In view of the combustion properties of DME having a high cetane number, DME has been studied as an alternative to diesel fuel, and many patents and papers designing a fuel supply system and remodeling the combustor have proposed to provide a diesel vehicle capable of using DME. However, development of a fuel nozzle of a gas turbine for DME has yet to be proposed.

A combustor according to the present invention is expected to enhance utility and reliability of a power plant through stable operation of a power plant running on DME, while reducing power generation costs with DME.

Accordingly, the present invention provides a fuel nozzle of a gas turbine combustor for DME and a design method thereof that can obtain optimal combustion of DME in a gas turbine of a power plant, thereby achieving cost reduction of power plants, enhancement in reliability of the power plants, and diversification of usable fuel.

DETAILED DESCRIPTION OF THE INVENTION

Exemplary embodiments of the present invention will be described in detail with reference to the accompanying drawings hereinafter.

Figure 1:
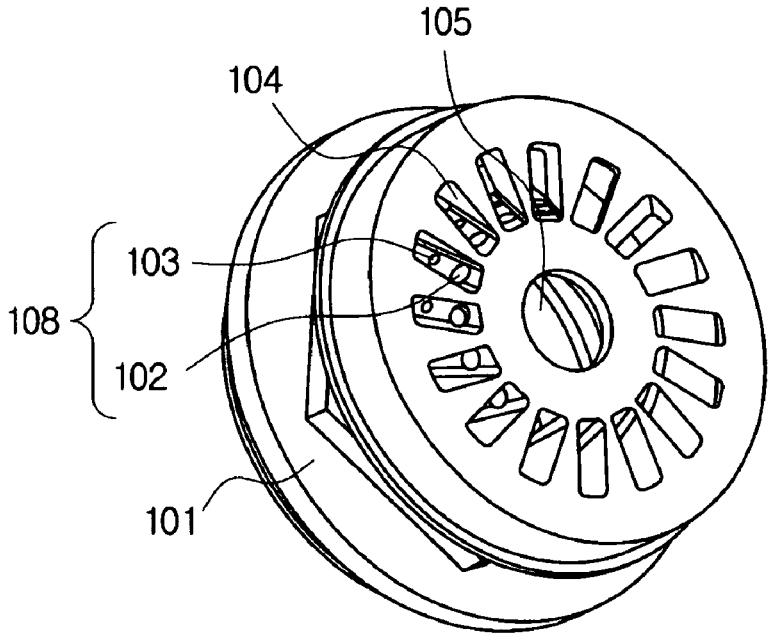
FIG. 1 is a perspective view of a fuel nozzle of a gas turbine combustor for dimethyl ether (DME) according to one embodiment of the present invention.
Figure 2:
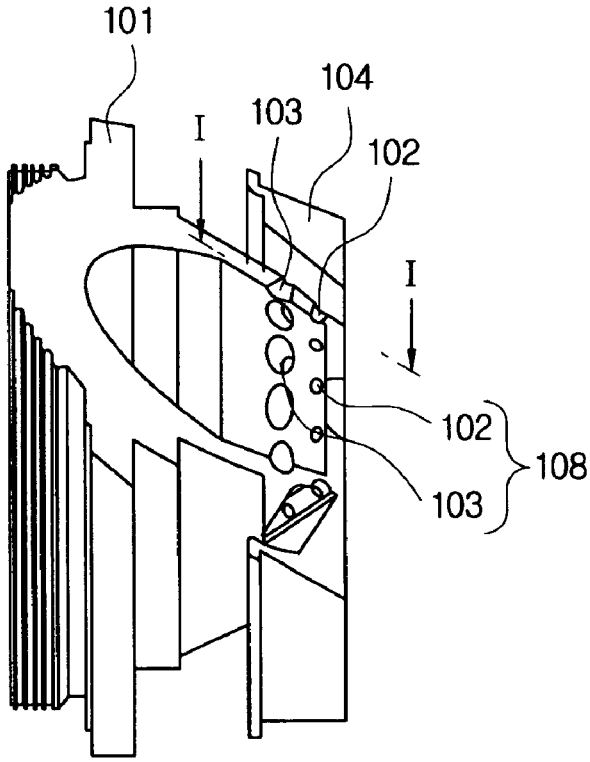
FIG. 2 is a partially cut-away perspective view of the fuel nozzle shown in FIG. 1.
Figure 3:
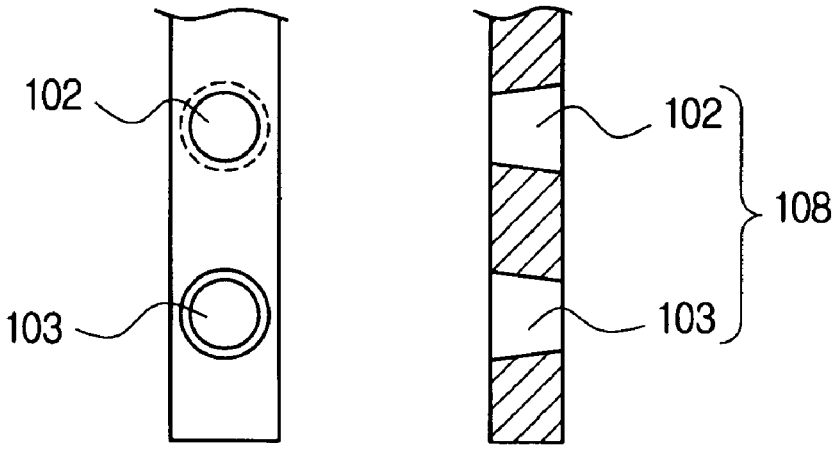
FIG. 3 is enlarged front and sectional views taken along line I-I in FIG. 2.
Figure 4:
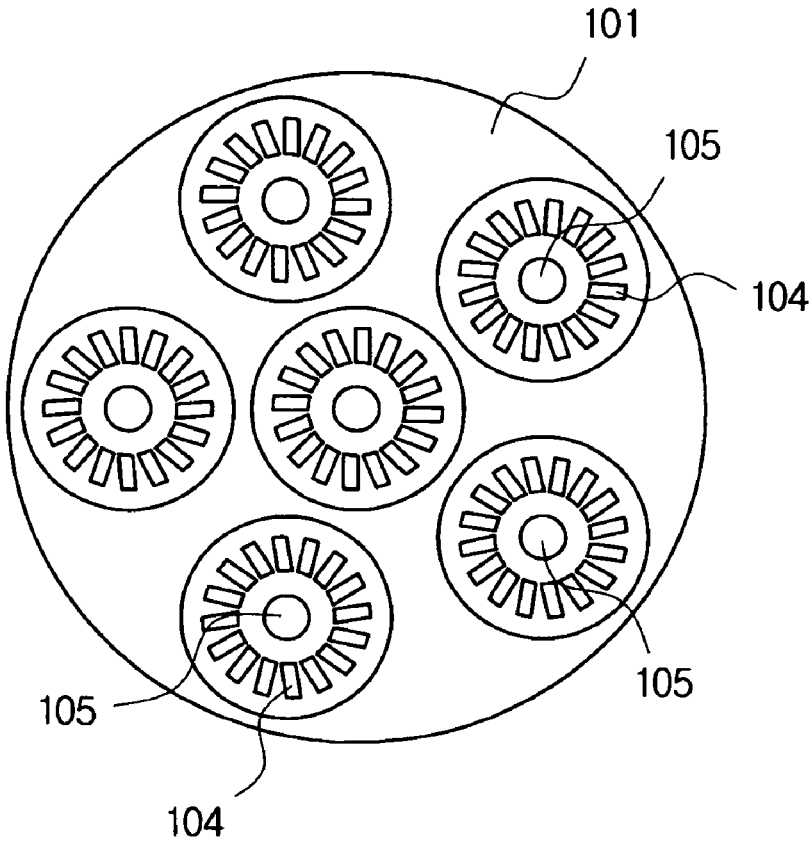
FIG. 4 is a front view of a multi-cup combustor including a plurality of fuel nozzles of the gas turbine combustor for DME according to the embodiment of the present invention.

FIG. 1 is a perspective view of a fuel nozzle of a gas turbine combustor for dimethyl ether (DME) according to one embodiment of the present invention, and FIG. 2 is a partially cut-away perspective view of the fuel nozzle shown in FIG. 1.

A fuel nozzle of a gas turbine combustor according to the present invention includes a pilot fuel injection hole 105 at the center thereof and a plurality of fuel injection ports 108 disposed at equiangular positions around the pilot fuel injection hole 105 to inject DME. Each of the fuel injection ports 108 includes a pair of upper and lower DME injection orifices 102 and 103 that communicate with a fuel-air mixture injection swirler 104. Further, the upper DME injection orifice 102 becomes gradually wider, but the DME lower injection hole 103 becomes gradually narrower.

The foregoing fuel nozzle is designed as follows.

1. Design Method

[First Step]

With regard to a conventional natural gas combustor and a DME combustor, Wobbe indexes that indicate energy of heat input to the combustor are calculated.

As shown in Equation 1, the Wobbe index is expressed as a function of a heating value and a specific gravity.

$$WI = \frac{Q}{\sqrt{d}} \quad \text{(Equation 1)}$$

WI: Wobbe Index

Q: lower heating value (kcal/$Nm^3$)

d: specific gravity of gas at 0° C. and 1 atm.

[Second Step]

Under a condition of equalizing heat input on the basis of the Wobbe index obtained in the first step, the minimum cross-section sum of the fuel injection ports is calculated. (Here, the fuel gas injection pressure (P) has to be equally applied. This is because an increase in fuel has injection pressure leads to change in fuel injection distance and generates nitrogen oxides ($NO_x$) due to incomplete combustion and diffusion combustion.)

$$\text{Heat Input: } I = 0.011 \times D^2 \times K \times \sqrt{p} \times WI \quad \text{(Equation 2)}$$

I: heat input (kcal/hr)

D: diameter (mm) of nozzle

K: flux coefficient (about 0.8), constant

P: injection pressure of fuel gas ($mmH_2O$)

WI: Wobbe index

The heat inputs of natural gas (N.G.) and DME are calculated by the following Equations 3 and 4.

$$\text{Natural Gas Heat Input: } I_{N.G.}=0.011\times(D_{N.G.})^2\times K\times\sqrt{p_{N.G.}}\times WI_{N.G.} \quad \text{(Equation 3)}$$

$$\text{DME Heat Input: } I_{DME}=0.011\times(D_{DME})^2\times K\times\sqrt{p_{DME}}\times WI_{DME} \quad \text{(Equation 4)}$$

$$I_{N.G.}=I_{DME} \quad \text{(Equation 5)}$$

Further, the above equations are rearranged into Equation 6 by substituting Equations 3 and 4 into Equation 5 and using physical properties in Table 1.

$$D_{DME}=\sqrt{\frac{WI_{N.G.}}{WI_{DME}}}\times D_{N.G.}1.086\times D_{N.G.} \quad \text{(Equation 6)}$$

However, the enlarging ratio, 1.086, of the fuel injection port has to be calculated from the measured heating values of natural gas and DME, and the enlarging ratio may be designed in the range of 105~150% according to change in the physical properties of natural gas and DME.

TABLE 1

Physical properties of natural gas and DME

| | Natural gas | DME |
|---|---|---|
| Heating Value [kcal/Nm$^3$] | 10,500 | 14,164 |
| Specific Gravity (vs. air) | 0.625 | 1.586 |
| Wobbe Index | 13,281 | 11,247 |

In the fuel nozzle 101 according to the present invention, the total area of the fuel injection port 108 having the upper and lower DME injection orifices 102 and 103 is designed to be larger by 105~150% than that of the conventional natural gas combustor.

[Third Step]

To enhance combustion performance such as $NO_x$ reduction, combustion efficiency, flame-back prevention, etc. under the same heat input condition, the fuel injection port 108 is designed to meet the following conditions ①, ② and ③.

The same heat input could be accomplished when changing only the diameter of the fuel injection port with the resultant value obtained in the second step, but experimental results showed that $NO_x$ increases but combustion efficiency decreases. To complement these results, the number of fuel injection ports 108 is increased and the fuel injection ports are positioned uniformly in upper and lower streams. Consequently, the combustion efficiency can be increased due to prevention of flame back and a sufficient increase in mixture ratio of fuel and air.

① To ensure swirling flow and uniform distribution of fuel, the fuel nozzle 101 of the present invention is designed to have the fuel injection ports 108 each divided into the upper DME injection orifice 102 at an upper stream and the lower DME injection orifice 103 at a lower stream, in which the minimum cross-section sum of total fuel injection ports 108 is equal to $$D_{DME}=\sqrt{(D_{N.G.})^2\times\frac{WI_{N.G.}}{WI_{DME}}}=1.086\times D_{N.G.}$$

as is obtained in the second step.

② The upper DME injection orifice 102: since the fuel injection port 108 is disposed near a combustion chamber, it is necessary to maintain a smooth surface for the purpose of preventing separation of a flow to reduce combustion oscillation and to distribute the fuel uniformly. Accordingly, the upper DME injection orifice 102 is designed to have a channel that becomes gradually wider toward an outlet of fuel.

③ The lower DME injection orifice 103: since the fuel injection port 108 is farther apart from the combustion chamber than the upper DME injection orifice 102, it has a longer fuel injection distance toward air than the upper DME injection orifice 102, and thus, it is necessary to have a regular jet shape. Accordingly, the lower DME injection orifice 102 is designed to have a channel tapered toward an outlet of the fuel.

As described above, the present invention proposes the method of designing the fuel nozzle which is considered as an important factor in redesigning a gas turbine combustor for natural gas into a gas turbine combustor for DME. The present invention enables stable operation of the gas turbine combustor for DME with improved combustion efficiency and reduced amounts of harmful gases such as $NO_x$ or the like.

Accordingly, the present invention promotes utility of DME as a fuel for power plants while achieving cost reduction of the power plants, enhancement in reliability of the power plants, and diversification of usable fuels.

Although the present invention has been described with reference to the embodiments and the accompanying drawings, the invention is not limited to the embodiments and the drawings. It should be understood that various modifications and changes can be made by those skilled in the art without departing from the spirit and scope of the present invention as defined by the accompanying claims.

What is claimed is:

1. A fuel nozzle of a gas turbine combustor for dimethyl ether (DME) comprising;

a pilot fuel injection hole formed at a center of the fuel nozzle; and a plurality of fuel injection ports formed at equiangular positions around the pilot fuel injection hole to inject DME, wherein each of the fuel injection ports comprises a pair of upper and lower DME injection orifices communicating with a fuel-air mixture injection swirler, in which the upper DME injection orifice is formed in a cone shape becoming gradually wider in a downstream direction, whereas the lower DME injection orifice is formed in a cone shape becoming gradually narrower in a downstream direction.

2. The fuel nozzle of a gas turbine combustor for dimethyl ether according to claim 1, wherein the fuel nozzle is provided in plural to constitute a multi-cup gas turbine combustor.

3. A method of designing a fuel nozzle of a gas turbine combustor for dimethyl ether (DME) to have fuel injection ports, comprising the steps of:

providing a pilot fuel injection hole at a center of the fuel nozzle;

disposing a plurality of fuel injection ports at equiangular positions around the pilot fuel injection hole; and disposing a pair of upper and lower DME injection orifices respectively at an upper and lower direction of streams in each fuel injection port, wherein a total area of the fuel injection ports is designed to be 105~150% larger than that of a gas turbine combustor for natural gas, and wherein the upper DME injection orifice is formed in a cone shape becoming gradually wider in a downstream direction, whereas the lower DME injection orifice is formed in a cone shape becoming gradually narrower in a downstream direction.

4. The method of designing a fuel nozzle of a gas turbine combustor for dimethyl ether (DME) according to claim 3, wherein sixteen fuel injection ports are disposed around the pilot fuel injection hole.

* * * * *